US005890934A

United States Patent [19]

Brooks et al.

[11] Patent Number: 5,890,934

[45] Date of Patent: Apr. 6, 1999

[54] PLUGGABLE CONNECTOR ASSEMBLY FOR PRINTED CIRCUIT BOARDS

[75] Inventors: David M. Brooks, Midlothian; Phillip C. Dobler, Mechanicsville; David S. Bennett, Richmond, all of Va.

[73] Assignee: Weidmuller Inc., Richmond, Va.

[21] Appl. No.: 940,877

[22] Filed: Sep. 30, 1997

[51] Int. Cl.[6] ..... H01R 9/26

[52] U.S. Cl. ..... 439/716; 439/78

[58] Field of Search ..... 439/78, 82, 709, 439/715, 716

[56] References Cited

U.S. PATENT DOCUMENTS

| | | |
|---|---|---|
| 3,245,029 | 4/1966 | Piperato . |
| 4,171,152 | 10/1979 | Geiseler . |
| 4,270,835 | 6/1981 | Kordt et al. . |
| 5,588,881 | 12/1996 | Eggert et al. . |
| 5,658,172 | 8/1997 | Schmidt et al. . |

*Primary Examiner*—Khiem Nguyen
*Attorney, Agent, or Firm*—Laubscher & Laubscher

[57] ABSTRACT

A pluggable assembly for printed circuit boards includes a mounting rail of generally U-shaped cross-sectional configuration having a base portion mounted on one face of the printed circuit board, and a pair of arm portions extending normal to the base portion for supporting a transversely arranged terminal block, and a conductive pin extending from the terminal block through an opening contained in the mounting rail base portion for connection with a conductive layer on the remote face of the printed circuit via a socket contact that extends through a corresponding opening contained in the printed circuit board. A multi-contact connector may be fastened to the one face of the printed circuit board for connecting a plurality of connector contacts with a plurality of corresponding terminal blocks mounted in side-by-side relation on the mounting rail via separate conductive layers arranged on the remote side of the printed circuit board, and corresponding socket terminal and pin devices that extend through corresponding openings contained in the printed circuit board, respectively.

8 Claims, 3 Drawing Sheets

PLUGGABLE CONNECTOR ASSEMBLY FOR PRINTED CIRCUIT BOARDS

BACKGROUND OF THE INVENTION

1. Field of the Invention

This invention relates to a pluggable connector assembly for printed circuit boards including a mounting rail of generally U-shaped cross-section having a horizontal base portion connected with one face of the printed circuit board, and a pair of vertical arm portions extending upwardly from the base portion, a terminal block mounted transversely across the upper ends of the rail arm portions, and means electrically connecting a contact on the terminal block with a conductive layer arranged on the remote side of the printed circuit board via a conductive pin and socket arrangement that extends downwardly in spaced relation through a opening contained in the rail base portion, and through a corresponding opening contained in the printed circuit board.

2. Brief Description of the Prior Art

It is well known in the patented prior art to mount an electrical terminal block on a mounting rail, as disclosed by the U.S. patents to Piperato U.S. Pat. No. 3,245,029, Kordt et al U.S. Pat. No. 4,270,835, Eggert et al U.S. Pat. No. 5,588,881, and Schmidt et al, U.S. Pat. No. 5,658,172 among others. The Geisler patent U.S. Pat. No. 4,171,152 discloses an electrical contact that can be mounted on a printed circuit board.

A need has developed in the electrical connector art to provide a connector arrangement for electrically connecting the electrical contacts of various types of terminal blocks in a quick, robust manner with the conductive layer portions of a printed circuit board. The present invention was developed to provide such a connector arrangement that is operable to connect various types of terminal blocks with various types and patterns of printed circuit boards, and with multi-contact connectors mounted thereon.

SUMMARY OF THE INVENTION

Accordingly, it is a primary object of the present invention to provide a pluggable connector assembly including a mounting rail for mounting one or more terminal blocks on a printed circuit board in electrical contact with selective conductive layer portions of a printed circuit pattern provided on the board.

A more specific object of the invention is to provide a terminal block having a conductive pin that extends downwardly between the integral resilient mounting foot portions of the terminal block via a slot contained in the bottom portion of the mounting rail for insertion within a corresponding socket contact that extends through an opening contained in the printed circuit board, thereby to afford electrical connection with selected positions of the associated conductive layer pattern that is formed on the bottom surface of the printed circuit board.

Another object of the invention is to provide a pluggable connector assembly including a plurality of terminal blocks mounted on the upper surface of a printed circuit board in spaced relation to a multi-contact connector that is bolted within an opening contained in the circuit board, the printed circuit board having on its lower surface a conductive layer pattern that defines conductive paths between the contacts of the multi-contact connector and the downwardly extending conductive pins of the terminal blocks, respectively.

BRIEF DESCRIPTION OF THE DRAWINGS

Other objects and advantages of the invention will become apparent from a study of the following specification when viewed in conjunction with the accompanying drawings, in which.

DETAILED DESCRIPTION

Figure 1:
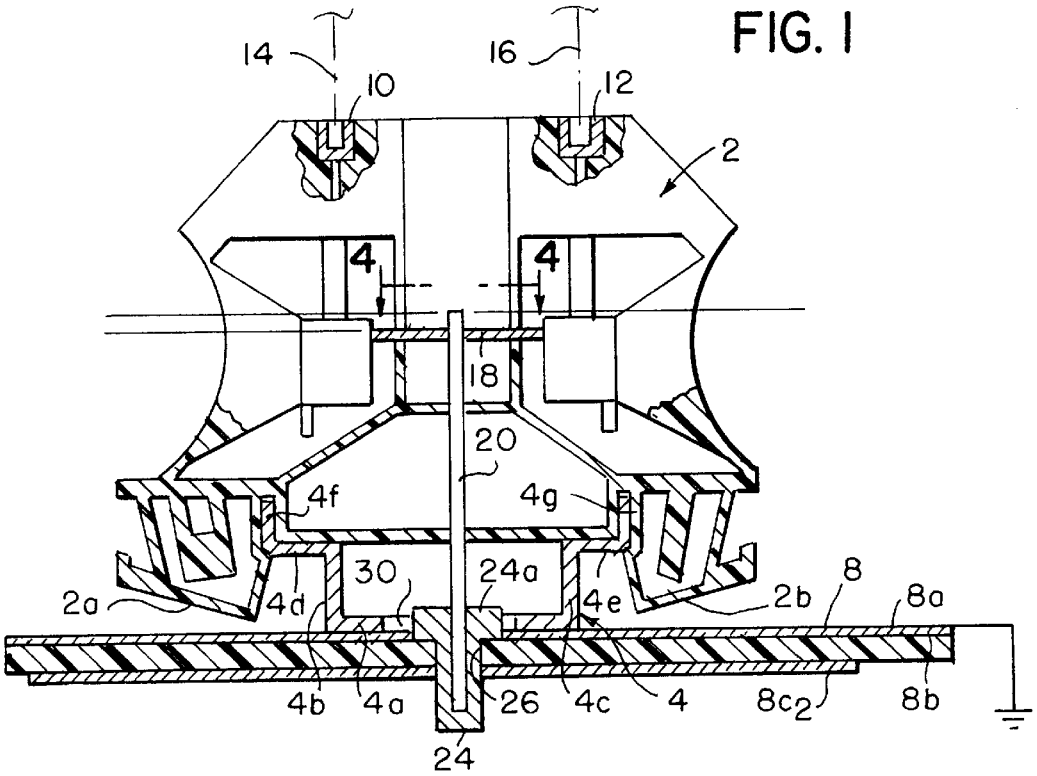
FIG. 1 is a sectional view taken along line 1—1 of FIG. 2, illustrating a first terminal block embodiment of a pluggable terminal block assembly in accordance with the present invention.

Referring first more particularly to FIGS. 1–4, the rail-mounted terminal block assembly of the present invention includes a terminal block 2 that is mounted on a rigid metal mounting rail 4 that is bolted by bolts 6 to a printed circuit board 8. As is customary in the art, the terminal block 2 is provided with input lead contacts 10 and 12 such as screw terminals, for example, for connection with conductors 14 and 16, respectively. In the illustrated embodiment, the lead-end contacts are connected by a transverse bus bar 18 having an opening for receiving the upper end of a pin connector 20 that is soldered thereto.

The mounting rail 4 has a generally U-shaped cross-sectional configuration and includes a horizontal base portion 4*a* that is bolted to the upper surface of the printed circuit board 8, a pair of upwardly extending vertical arm portions 4*b* and 4*c*, a pair of outwardly extending flange portions 4*d* and 4*e*, an a pair of upwardly extending end portions 4*f* and 4*g*, respectively. The terminal block 2, which is formed of synthetic plastic material, includes a pair of resilient foot portions 2*a* and 2*b* that are snapped beneath the horizontal flange portions 4*d* and 4*e* of the mounting rail 4.

Figure 2:
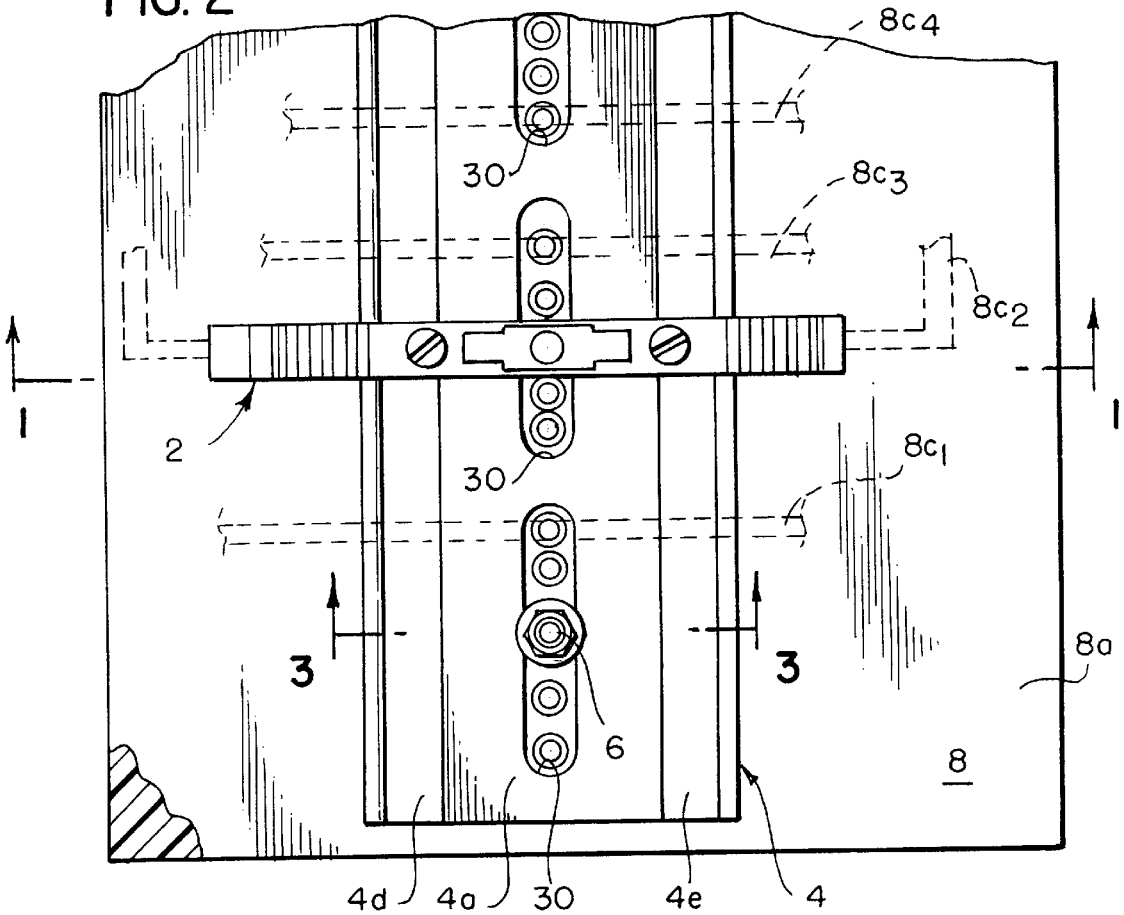
FIG. 2 is a top plan view of the assembly of FIG. 1.

The printed circuit board 8 has an upper layer 8*a*, a base layer 8*b* formed of a suitable synthetic plastic insulating material, and a conductive bottom layer having a plurality of conductor-defining portions $8c_1$, $8c_2$, $8c_3$, and $8c_4$, as shown in FIG. 2. The printed circuit conductive layers are connected with conductive socket members 24 that extend through corresponding through openings 26 contained in the printed circuit board. The base portion 4*a* of the mounting rail contains one or more longitudinally extending slots 30 that are oversized relative to the upper outwardly directed flange portion 24*a* of the socket contact 24. Thus, the socket 24 is an electrical engagement with the corresponding conductive printed circuit portion 8*c*, but is electrically isolated from the mounting rail 4. The lower extremity of the vertical connecting pin 20 extends within the socket 24 for electrical connection with the associated printed circuit conductive layer portion 8*c*(2).

Figure 3:
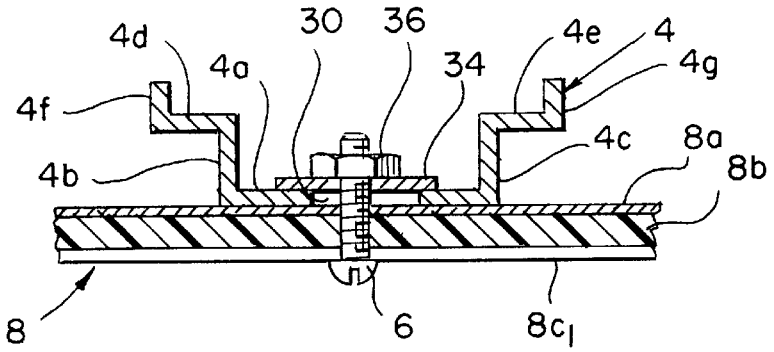
FIG. 3 is a detailed sectional view taken along line 3—3 of FIG. 2.
Figure 4:
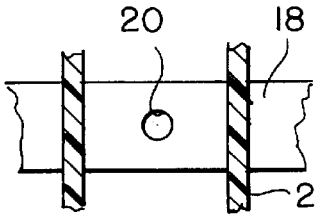
FIG. 4 is a detailed sectional view taken along line 4—4 of FIG. 1.

Referring to FIG. 3, the mounting rail 4 is bolted to the printed circuit board 8 by a plurality of screws 6 that extend upwardly through a corresponding through bore contained in the printed circuit board 8, through the slot 30 contained in the mounting rail 4, and through the central opening of a washer 34, which washer is pressed against the horizontal rail portion 4*a* by the nut 36 that is threaded upon the free end of the bolt 6. FIG. 4 is a detailed view illustrating the manner in which the connecting pin 2 extends to a corresponding opening contained in the bus bar portion 18.

Figure 5:
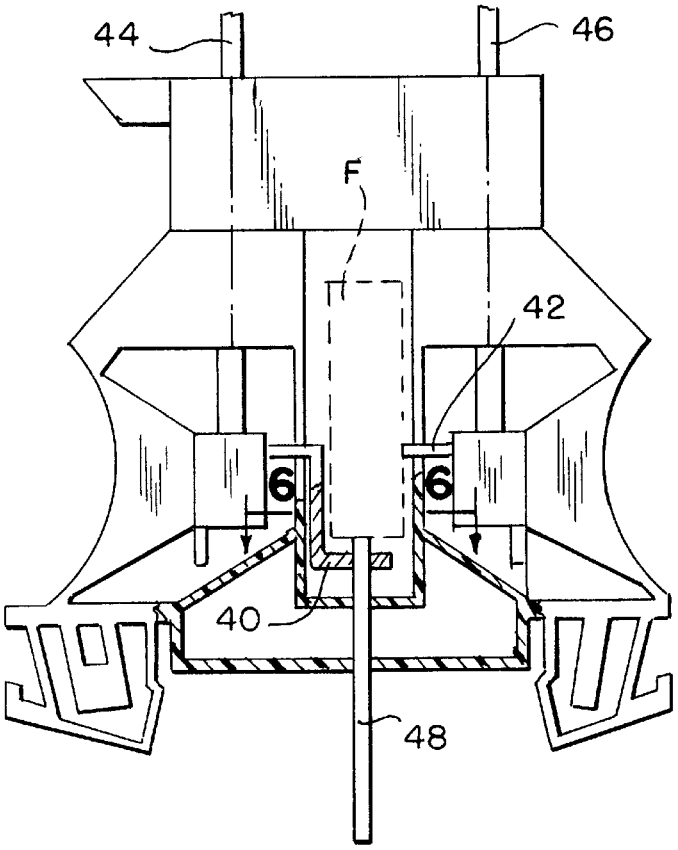
FIG. 5 is a partly sectioned side elevational view of a second terminal block embodiment of the invention.
Figure 6:
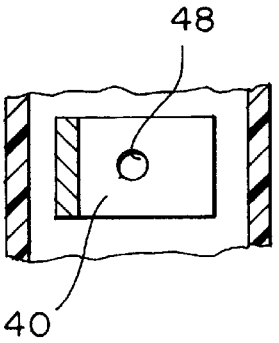
FIG. 6 is a sectional view taken along line 6—6 of FIG. 5.

It is obvious that various types of electrical connections may be made by the use of various types of terminal blocks. In the embodiment of FIG. 1, the pin 20 contacts the bus bar 18 which electrically connects the conductors 14 and 16, thereby to tap the connection between conductors 14 and 16. In the embodiment of FIG. 5, a fuse F is connected between the internal bus bar connections 40 and 42 that in turn are connected with the conductors 44 and 46, respectively. The connecting pin 48 extends at its upper end within an opening contained in the L-shaped bus bar 40 and extends at its other end downwardly for pluggable insertion within a corresponding socket contained in a printed circuit board, in the same manner illustrated in FIG. 1.

Figure 7:
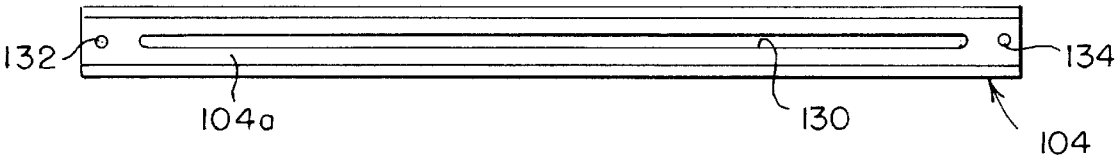
FIG. 7 is a top plan view of another mounting rail embodiment having a single longitudinal through slot.
Figure 8:
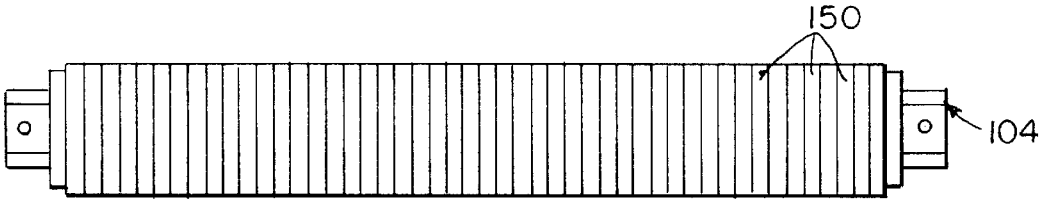
FIG. 8 illustrates a plurality of terminal blocks mounted on the mounting rail of FIG. 7.
Figure 9:
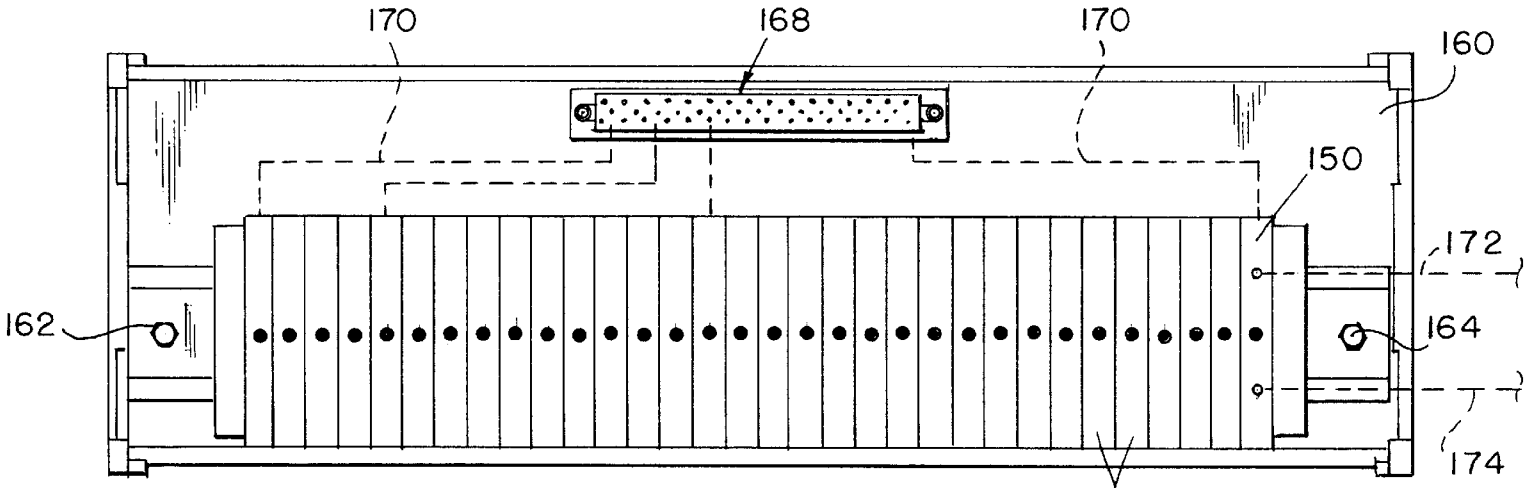
FIG. 9 illustrates the assembly of FIG. 8 mounted on a printed circuit board together with a multi-contact connector.

Referring now to FIG. 7, the mounting rail 104 has a base portion 104a that contains a single slot 130 that extends substantially the length of the mounting rail, the ends of the mounting rail being provided with openings 132 and 134 for receiving the bolts that connect the rail with a printed circuit board. A plurality of terminal blocks 150 are mounted on the mounting rail 104 as shown in FIG. 8, whereupon this mounting rail assembly is then bolted to the user's printed circuit board 160 by bolt means 162 and 164. The connecting pins of the terminal blocks extend downwardly into corresponding socket contacts contained in the printed circuit board in the manner illustrated in FIG. 1. Also connected with the printed circuit board 160 is a multi-contact connector 168 having a body portion that preferably extends within a corresponding opening contained in the printed circuit board. The various contacts of the multi-contact connector 168 are connected with the associated printed circuit conductive portions 170 provided on the bottom surface of the printed circuit board, respectively, the other ends of the conductive layer portions being connected with the socket terminals associated with the various terminal blocks 150. Input leads 172 and 174 extend to the various terminal block contacts, as shown in FIG. 9.

Thus, the connector assembly affords means for connecting a plurality of conductors to various conductive portions of a printed circuit pattern in a rugged and durable manner, and also provides means for electrical connection with a multi-contact connector mounted on the printed circuit board.

While in accordance with the provisions of the Patent Statutes, the preferred forms and embodiments of the invention have been illustrated and described, it will be apparent to those skilled in the art that various changes and modifications may be made without deviating from the inventive concepts set forth above.

What is claimed is:

1. A pluggable connector assembly for use with a printed circuit board including a generally planar base layer formed of insulation material and having a pair of remote faces, and at least one conductive layer mounted on a portion of one of the base layer remote faces, comprising:

(a) a generally linear mounting rail having a generally U-shaped transverse cross-section including a horizontal generally rectangular base portion, a pair of generally vertical arm portions extending upwardly from opposed longitudinal edges of said base portion, respectively, and a pair of horizontal flange portions extending outwardly from the upper ends of said arm portions, respectively, said base portion containing at least one opening;

(b) means for mounting said mounting rail on the other of the printed circuit board remote faces;

(c) a vertical terminal block arranged transversely above said mounting rail, said terminal block including a top portion containing at least one lead-in conductor terminal, and a bottom portion;

(d) means removably connecting said terminal block bottom portion with said rail flange portions; and (e) means for connecting said conductor terminal with the printed circuit board conductive layer, including:

(1) a female plug contact adapted to extend through an opening contained in the printed circuit board adjacent the conductive layer portion, and opposite and in spaced relation to the wall of said mounting rail opening; and (2) a vertical pin extending downwardly from the bottom of said terminal block and into said female plug contact via said rail opening.

2. A pluggable connector assembly as defined in claim 1, wherein said means for removably connecting said terminal block with said mounting rail comprises a pair of horizontally-spaced resilient foot portions that are arranged to snap beneath said rail flange portions, respectively.

3. A pluggable connector assembly as defined in claim 2, wherein said mounting rail includes a bolt that extends through aligned openings contained in said mounting rail and the printed circuit board.

4. A pluggable connector as defined in claim 1, wherein said means for connecting said terminal with said printed circuit board conductive layer includes a bus bar containing a through opening that receives said vertical pin, said pin being soldered to said bus bar.

5. A pluggable connector as defined in claim 4, wherein said terminal block includes a second conductor lead-in terminal contained in said terminal block top portion, and means connecting said second conductor lead-in with said bus bar.

6. A pluggable connector as defined in claim 5, wherein said means connecting said second conductor lead-in terminal with said bus bar includes a fuse.

7. A pluggable connector circuit board assembly, comprising:

(a) a planar generally rectangular printed circuit board having a base layer formed of insulating material and having a pair of remote faces, and a plurality of conductive layer portions arranged on one of said remote faces;

(b) a generally linear mounting rail having a generally U-shaped transverse cross-section including a horizontal generally rectangular base portion, a pair of generally vertical arm portions extending upwardly from opposed longitudinal edges of said base portion, respectively, and a pair of horizontal flange portions extending outwardly from the upper ends of said arm portions, respectively, said base portion containing at least one opening;

(c) means for mounting said mounting rail on the other of said printed circuit board remote faces;

(d) a plurality of vertical terminal blocks arranged transversely above said mounting rail, each of said terminal blocks including a top portion containing at least one lead-in conductor terminal, and a bottom portion;

(e) means removably connecting each of said terminal block bottom portions with said rail flange portions, respectively; and (f) means for connecting the lead-in conductor terminals of said terminal blocks with associated printed circuit board conductive layer portions, respectively, including:

(1) a plurality of female plug contacts extending through openings contained in the printed circuit board adjacent and in electrical engagement with the conductive layer portions, respectively, each of said female plug contacts being opposite and in spaced relation to a corresponding opening contained in said mounting rail, respectively; and (2) a plurality of vertical pins extending downwardly from the bottoms of said terminal blocks and into said female plug contacts via associated mounting rail openings, respectively.

8. A pluggable assembly as defined in claim 7, and further including a multi-contact connector mounted on said other face of said printed circuit board and extending through a further opening contained in said printed circuit board, the contacts of said multi-contact connector being connected with said conductive layer portions, respectively.

* * * * *